US010639903B2

(12) United States Patent
McAuliffe et al.

(10) Patent No.: US 10,639,903 B2
(45) **Date of Patent: *May 5, 2020**

(54) INK REGULATOR TANK FOR USE WITH DEGASSED INKS

(71) Applicant: Memjet Technology Limited, Dublin (IE)

(72) Inventors: Patrick McAuliffe, North Ryde (AU); Samuel Mallinson, North Ryde (AU); Geordie McBain, North Ryde (AU)

(73) Assignee: MEMJET TECHNOLOGY LIMITED (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/167,403

(22) Filed: Oct. 22, 2018

(65) Prior Publication Data

US 2019/0054744 A1 Feb. 21, 2019

Related U.S. Application Data

(63) Continuation-in-part of application No. 15/894,013, filed on Feb. 12, 2018, now Pat. No. 10,427,414.

(60) Provisional application No. 62/463,440, filed on Feb. 24, 2017.

(51) Int. Cl.
*B41J 2/175* (2006.01)
*B41J 2/18* (2006.01)

(52) U.S. Cl.
CPC ..... *B41J 2/17566* (2013.01); *B41J 2/175* (2013.01); *B41J 2/17523* (2013.01); *B41J 2/17553* (2013.01); *B41J 2/18* (2013.01)

(58) Field of Classification Search
CPC combination set(s) only.
See application file for complete search history.

(56) References Cited

U.S. PATENT DOCUMENTS

2009/0231401 A1 9/2009 Morgan et al.

FOREIGN PATENT DOCUMENTS

| | | | |
|---|---|---|---|
| EP | 1 466 737 | A1 | 10/2004 |
| WO | WO-2014/001816 | A1 | 1/2014 |
| WO | WO-2014/009232 | A1 | 1/2014 |

OTHER PUBLICATIONS

International Search Report dated May 7, 2018, for PCT Application No. PCT/EP2018/053367, filed on Feb. 9, 2018, 4 pages.
Written Opinion of the International Searching Authority dated May 7, 2018, for PCT Application No. PCT/EP2018/053367, filed on Feb. 9, 2018, 9 pages.

*Primary Examiner* — Bradley W Thies
(74) *Attorney, Agent, or Firm* — Cooley LLP

(57) ABSTRACT

An ink tank for an ink delivery system includes: a first ink chamber having an ink inlet port and an ink outlet port; a second ink chamber positioned above the first ink chamber and having a roof defining a tortuous vent pathway open to atmosphere via a gas port; and a diffusion tube interconnecting the first and second ink chambers. The first ink chamber has a smaller volume than the second ink chamber and the diffusion tube minimizes diffusion of air from the second chamber to the first chamber.

17 Claims, 5 Drawing Sheets

INK REGULATOR TANK FOR USE WITH DEGASSED INKS

CROSS-REFERENCE TO RELATED APPLICATIONS

The present application is a Continuation-in-Part of U.S. application Ser. No. 15/894,013 filed Feb. 12, 2018, which claims the benefit of priority to U.S. Provisional Application No. 62/463,440 filed Feb. 24, 2017, the contents of which are incorporated herein by reference for all purposes.

FIELD OF THE INVENTION

This invention relates to an ink tank for use in an ink delivery system of an inkjet printer. It has been developed primarily for supplying degassed ink to a printhead using gravity regulation of ink pressure.

BACKGROUND OF THE INVENTION

Inkjet printers employing Memjet® technology are commercially available for a number of different printing formats, including small-office-home-office ("SOHO") printers, label printers and wideformat printers. Memjet® printers typically comprise one or more stationary inkjet printheads, which are user-replaceable. For example, a SOHO printer comprises a single user-replaceable multicolored printhead, a high-speed label printer comprises a plurality of user-replaceable monochrome printheads aligned along a media feed direction, and a wideformat printer comprises a plurality of user-replaceable printheads in a staggered overlapping arrangement so as to span across a wideformat pagewidth.

Supplying ink to high-speed printheads can be problematic due to high ink flow requirements and the need to maintain supplied ink within a predetermined pressure range. Typically, inkjet printheads require ink to be supplied at a negative ink pressure (i.e. less than atmospheric pressure) and various ink delivery systems have been developed for providing a stable, negative ink pressure for a printhead.

In a gravity-feed ink delivery system, a pressure-regulating tank is positioned below the height of the printhead and has a gas port open to atmosphere. A level of ink in the tank is maintained relatively constant, for example, by controlling a supply of ink into the tank. A difference in height between the printhead and the head of ink in the pressure-regulating tank controls the backpressure in the printhead. Controlling the level of ink in the pressure-regulating tank may be achieved by any suitable means. For example, a float valve mechanism may be used to control the supply of ink into the tank, as described in U.S. Pat. No. 8,066,359, the contents of which are incorporated by reference. Alternatively, sensors may be used to detect the level of ink in the pressure-regulating tank and a valve and/or ink pump arrangement may be used to control the flow of ink into the tank via a suitable feedback and control system.

In other ink delivery systems, negative pressure is provided by connecting a gas port of the pressure-regulating tank to a pump. The pump is operable to provide a variable pressure in the headspace of the tank e.g. a constant negative headspace pressure for normal printing. In this way, the ink pressure is independent of the height of the tank thereby enabling more flexibility in the printer design.

A problem with the above-described ink delivery systems is that ink is necessarily exposed to air. However, some printheads perform optimally when supplied with degassed ink, which minimizes the risk of air bubbles affecting the performance of the printhead during long print runs. Exposure of degassed ink to air is problematic, because ink (especially turbulent ink) is readily regassed when in contact with air, thereby negating the benefits of using degassed ink. Accordingly, ink delivery systems which expose inks to air are not usually considered suitable for use with degassed inks.

It would be desirable to provide an ink delivery system and ink tank, which is suitable for use with degassed inks even when those inks are exposed to air for pressure regulation.

SUMMARY OF THE INVENTION

In one aspect, there is provided an ink tank for an ink delivery system comprising:

- a first ink chamber having an ink inlet port and an ink outlet port;
- a second ink chamber having a gas port open to atmosphere; and
- a diffusion tube interconnecting the first and second ink chambers, wherein the first ink chamber has a smaller volume than the second ink chamber.

The ink tank according to the first aspect is suitable for use as an intermediary tank in a gravity feed ink delivery system. In use, the first ink chamber can be fed with degassed ink via the inlet port and supply the degassed ink to a printhead via the outlet port. However, since the second ink chamber is relatively diffusionally isolated from the first ink chamber by virtue of the diffusion tube, any aerated ink in the first ink chamber does not mix with the degassed ink during normal operation of the printer. Nevertheless, fluidic communication between the second ink chamber and the first ink chamber still enables gravity control of ink pressure in the first ink chamber. Therefore, the ink tank advantageously regulates the ink pressure in a supply of degassed ink using gravity without regassing of the ink.

In some embodiments, the diffusion tube extends from a roof of the first ink chamber to a base of the second ink chamber. In other embodiments, the diffusion tube extends from the first ink chamber into an internal space of the first ink chamber. Preferably, the first ink chamber has a smaller volume than the second ink chamber.

Preferably, the roof of the first ink chamber is tapered towards the diffusion tube. This arrangement advantageously encourages air bubble to float upwards towards the second ink chamber via the diffusion tube.

Preferably, the second ink chamber has a larger cross-sectional area than the first ink chamber. This arrangement advantageously dampens height fluctuations of the level of the ink in the second ink chamber.

Preferably, the diffusion tube has a bubble-tolerant internal cross-sectional shape.

Preferably, the internal cross-sectional shape includes one or more liquid flow sections resistant to bubble occlusion. For example, the internal cross-sectional shape may selected from the group consisting of star-shaped, triangular, 'T'-shaped, cross-shaped, clover-shaped and a polygon having a notched portion. These and other bubble-tolerant tubing types will be well known the person skilled in the art and are described in, for example, U.S. Pat. No. 8,118,418, the contents of which are incorporated herein by reference.

Preferably, the ink has a diffusivity in the range of 0.5 to 1.0 □m2/ms. For example, the ink may have a diffusivity in the range of 0.6 to 0.9 □m2/ms. The ink may be a dye-based or pigment based ink.

Preferably, the diffusion tube has sidewalls impermeable to air.

Preferably, the diffusion tube has a length in the range of 1 to 10 cm. For example, the diffusion tube may have a length in the range of 3 to 6 cm.

Preferably, the diffusion tube has an aspect ratio of at least 3:1, at least 4:1 or at least 5:1.

Preferably, the diffusion tube is configured such that air dispersed in ink contained in the second ink chamber propagates along a length of the diffusion tube in a diffusion timescale of greater than 5 days. Preferably, the diffusion timescale is greater than 10 days, greater than 20 days or greater than 50 days.

In a second aspect, there is provided an ink delivery system for an inkjet printer comprising:

an ink supply reservoir;

an intermediary ink tank as defined hereinabove;

an inkjet printhead having a printhead inlet port connected to the outlet port of the first ink chamber; and a control system coordinating with the intermediary ink tank for controlling an ink pressure of ink delivered to the printhead.

In one embodiment, the control system comprises one or more sensors for sensing a level of ink in the second ink chamber, a flow control mechanism for controlling a flow of ink through the ink supply line and a controller connected to the sensors and the flow control mechanism.

In an alternative embodiment, the control system comprises one or more sensors for sensing gas pressure in a headspace of the second ink chamber and a vacuum pump connected to the gas port.

The first ink chamber may comprise an ink return port and the printhead may comprise a printhead outlet port connected to the ink return port via an ink return line to provide a closed fluidic loop between the printhead and the first ink chamber.

Preferably, the closed fluid loop comprises a pump and at least one valve.

Preferably, ink contained in the first ink chamber is relatively mobile and ink contained in the second ink chamber is relatively static.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "printer" refers to any printing device for marking print media, such as conventional desktop printers, label printers, duplicators, copiers, digital inkjet presses and the like. In one embodiment, the printer is a sheet-fed printing device.

BRIEF DESCRIPTION OF THE DRAWINGS

Embodiments of the present invention will now be described by way of example only with reference to the accompanying drawings, in which.

DETAILED DESCRIPTION OF THE INVENTION

Gravity-Feed Ink Delivery System

A gravity-feed ink delivery system is described hereinbelow as one exemplary use of the ink tank according to the first aspect. However, it will be appreciated that the ink tank according to the first aspect is equally suitable for use in any ink delivery system where ink in an intermediary ink tank is exposed to air.

Figure 1:
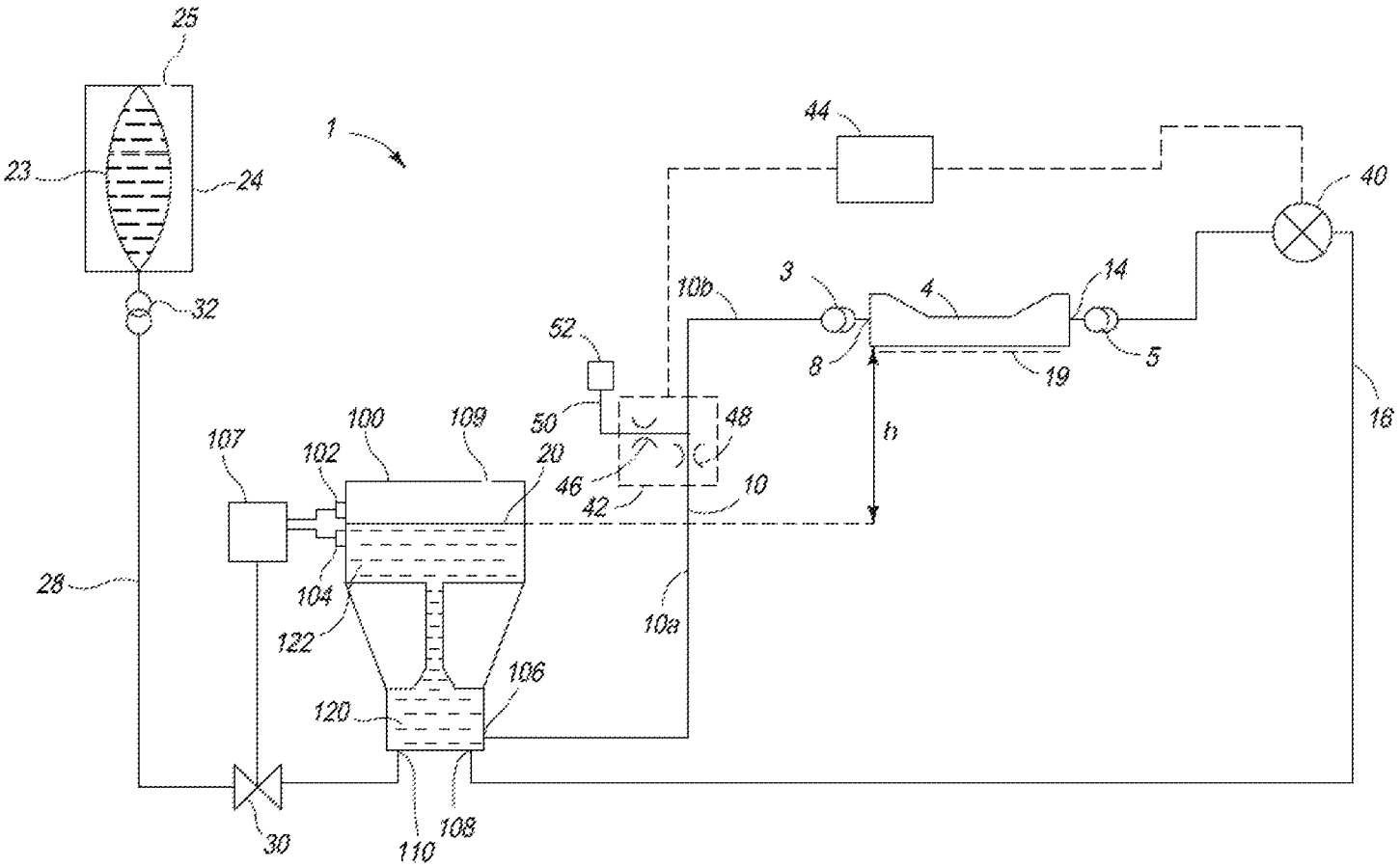
FIG. 1 shows schematically an ink delivery system according to the present invention.

Referring to FIG. 1, there is shown schematically a printer 1 having an ink delivery system for supplying ink to a printhead 4. The ink delivery system is a gravity-feed system, which is similar in function to those described in US2011/0279566 and US2011/0279562, the contents of which are herein incorporated by reference.

The ink delivery system comprises an intermediary ink tank 100 having an ink outlet port 106 connected to a printhead inlet port 8 of a printhead 4 via a first ink line 10. An ink return port 108 of the intermediary ink tank 100 is connected to a printhead outlet port 14 of the printhead 4 via a second ink line 16. Hence, the intermediary ink tank 100, the first ink line 10, the printhead 4 and the second ink line 16 define a closed fluidic loop. Typically, the first ink line 10 and second ink line 16 are comprised of lengths of flexible tubing.

The printhead 4 is user-replaceable by means of a first coupling 3 releasably interconnecting the printhead inlet port 8 and the first ink line 10; and a second coupling 5 releasably interconnecting the printhead outlet port 14 and the second ink line 16. The printhead 4 is a typically a pagewide printhead and may be, for example, a printhead as described in US2011/0279566 or U.S. Application No. 62/330,776 filed 2 May 2016 entitled "Monochrome Inkjet Printhead Configured for High-Speed Printing", the contents of which are incorporated herein by reference.

The intermediary ink tank 100 is open to atmosphere via a gas port in the form of an air vent 109 positioned in a roof of the tank. Accordingly, during normal printing, ink is supplied to the printhead 4 at a negative hydrostatic pressure ("backpressure") under gravity. In other words, gravity-feeding of ink from the intermediary ink tank 100, which is positioned below the printhead 4, provides a pressure-regulating system for supplying ink to the printhead at a predetermined negative hydrostatic pressure. The amount of backpressure experienced at the nozzle plate 19 of the printhead 4 is determined by the height h of the nozzle plate above a level of ink 20 in the intermediary ink tank 100.

Ink is supplied to an ink inlet port 110 of the intermediary ink tank 100 from a bulk ink reservoir comprising a collapsible ink bag 23 housed by a cartridge 24. The cartridge 24 is open to atmosphere via a cartridge vent 25 so that the collapsible ink bag 23 can collapse as ink is consumed by the system. The collapsible ink bag 23 is typically an air-impermeable foil bag containing degassed ink, which is supplied to the ink inlet port 110 via an ink supply line 28. The cartridge 24 is typically user replaceable and connected to the ink supply line 28 via a suitable ink supply coupling 32.

A control system is used to maintain a substantially constant level of ink in the intermediary ink tank 100 and, therefore, a constant height h and corresponding backpressure. As shown in FIG. 1, a control valve 30 is positioned in the ink supply line 28 and controls a flow of ink from the cartridge 24 into the intermediary ink tank 100. The control valve 30 is operated under the control of a first controller 107, which receives feedback from 'high' and 'low' sensors 102 and 104 (e.g. optical sensors) positioned at a sidewall of the intermediary ink tank 100. When the level of ink 20 falls below the 'low' sensor 104, the first controller 107 signals the valve 30 to be opened, and when the level of ink reaches the 'high' sensor 102, the controller signals the valve to close. In this way, the level of ink 20 in the intermediary ink tank 100 may be maintained relatively constant. The configuration of the intermediary ink tank 100 will be described in further detail hereinbelow.

The closed fluidic loop, incorporating the intermediary ink tank 100, the first ink line 10, the printhead 4 and the second ink line 16, facilitates priming, de-priming and other required fluidic operations. The second ink line 16 includes a reversible peristaltic pump 40 for circulating ink around the fluidic loop. By way of convention only, the "forward" direction of the first pump 40 corresponds to pumping ink from the ink outlet port 106 to the return port 108 (i.e. clockwise as shown in FIG. 1), and the "reverse" direction of the pump corresponds to pumping ink from the return port 108 to the ink outlet port 106 (i.e. anticlockwise as shown in FIG. 1).

The pump 40 cooperates with a pinch valve arrangement 42 to coordinate various fluidic operations. The pinch valve arrangement 42 comprises a first pinch valve 46 and a second pinch valve 48, and may take the form of any of the pinch valve arrangements described in, for example, US 2011/0279566; US 2011/0279562; and U.S. Pat. No. 9,180,676, the contents of which are incorporated herein by reference.

The first pinch valve 46 controls a flow of air through an air conduit 50, which is branched from the first ink line 10. The air conduit 50 terminates at an air filter 52, which is open to atmosphere and functions as an air intake for the closed fluidic loop.

By virtue of the air conduit 50, the first ink line 10 is divided into a first section 10*a* between the ink outlet port 106 and the air conduit 50, and a second section 10*b* between the printhead inlet port 8 and the air conduit 50. The second pinch valve 48 controls a flow of ink through the first section 10*a* of the first ink line 10.

The pump 40, the first pinch valve 46 and the second pinch valve 48 are controlled by a second controller 44, which coordinates various fluidic operations. From the foregoing, it will be appreciated that the ink delivery system shown in FIG. 1 provides a versatile range of fluidic operations. Table 1 describes various pinch valve and pump states for some example fluidic operations used in the printer 1. Of course, various combinations of these example fluidic operations may be employed.

TABLE 1

Example Fluidic Operations for Printer 1

| Fluidic Operation | Second Pinch Valve 48 | First Pinch Valve 46 | First Pump 40 |
|---|---|---|---|
| PRINT | open | closed | off |
| PRIME | open | closed | forward |
| STANDBY | open | closed | off |
| PULSE | closed | closed | reverse |
| DEPRIME | closed | open | forward |
| NULL | closed | closed | off |

During normal printing ("PRINT" mode), the printhead 4 draws ink from intermediary ink tank 100 at a negative backpressure under gravity. In this mode, the peristaltic pump 40 functions as a shut-off valve, whilst the first pinch valve 46 is closed and the second pinch valve 48 is open to allow ink flow from the ink outlet port 106 to the first port 8 of the printhead 4. During printing, ink is supplied to the ink inlet port 110 of the intermediary ink tank 100, under the control of the first controller 107, to maintain a relatively constant backpressure for the printhead 4.

During printhead priming or flushing ("PRIME" mode), ink is circulated around the closed fluidic loop in the forward direction (i.e. clockwise as shown in FIG. 1) with the control valve 30 closed. In this mode, the peristaltic pump 40 is actuated in the forward pumping direction whilst the first pinch valve 46 is closed and the second pinch valve 48 is open to allow ink flow from the ink outlet port 106 to the ink return port 108 via the printhead 4. Priming in this manner may be used to prime a deprimed printhead with ink.

In the "STANDBY" mode, the pump 40 is switched off whilst the first pinch valve 46 is closed and the second pinch valve 48 is open. The "STANDBY" mode maintains a negative hydrostatic ink pressure at the printhead 4, which minimizes color mixing on the nozzle plate 19 when the printer is idle. Usually, the printhead is capped in this mode to minimize evaporation of ink from the nozzles (see, for example, US2011/0279519, the contents of which are herein incorporated by reference).

In order to ensure each nozzle of printhead 4 is fully primed with ink and/or to unblock any nozzles which have become clogged, a "PULSE" mode may be employed. In the "PULSE" mode, the first and second pinch valves 46 and 48 are closed, while the pump 40 is actuated in a reverse direction (i.e. anticlockwise as shown in FIG. 1) to force ink through nozzles in the nozzle plate 19 of the printhead 4. The control valve 30 is closed during pulse priming the intermediary ink tank 100 provides a reservoir of ink required for pulse priming.

In order to replace a spent printhead 4, it is necessary to de-prime the printhead before it can be removed from the printer. In the "DEPRIME" mode, the first pinch valve 46 is open, the second pinch valve 48 is closed and the first pump 40 is actuated in the forward direction to draw in air from atmosphere via the air conduit 50. Once the printhead 4 has been deprimed of ink, the printer is set to "NULL" mode, which isolates the printhead from the ink supply, thereby allowing safe removal of the printhead with minimal ink spillages.

From the foregoing, it will be appreciated that a number of fluidic operations may be performed using the ink delivery system described above in connection with FIG. 1.

Intermediary Ink Tank (First Embodiment)

Figure 2:
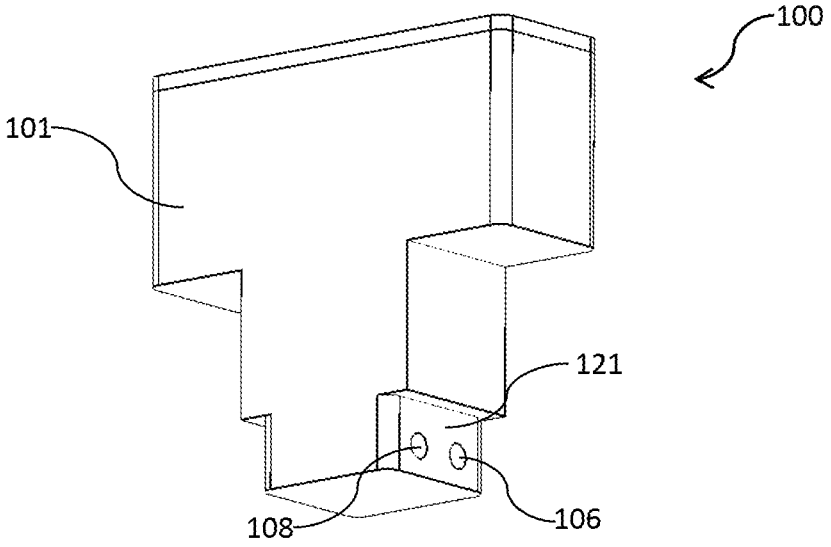
FIG. 2 is a perspective view of an ink tank according to a first embodiment.
Figure 3:
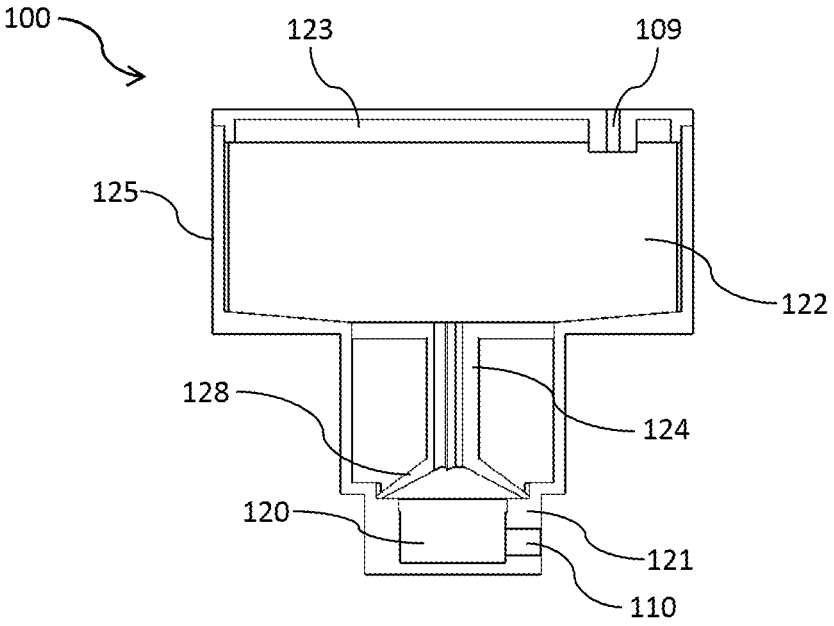
FIG. 3 is a front section of the ink tank shown in FIG. 2.
Figure 4:
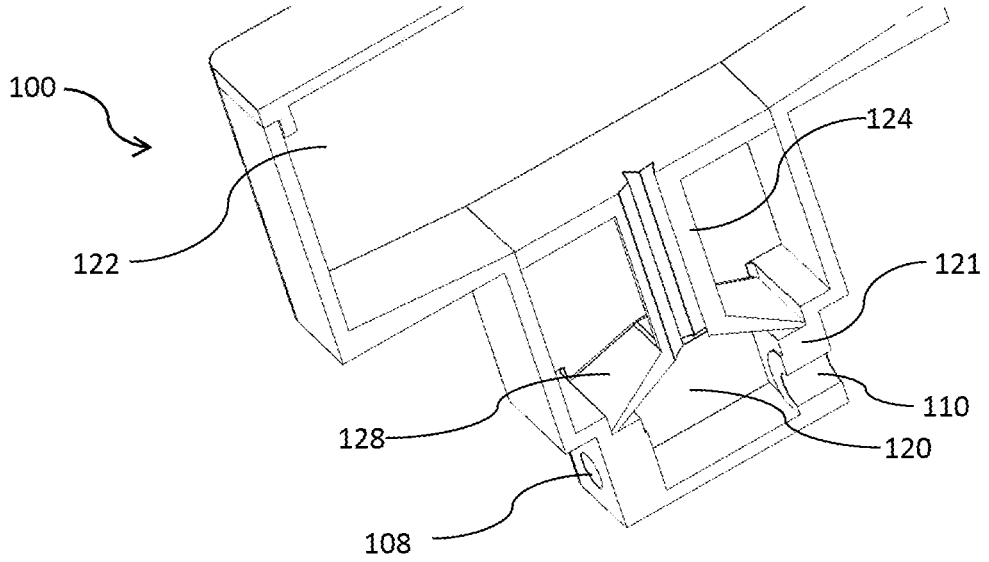
FIG. 4 is a perspective front section of the ink tank shown in FIG. 2.

Referring now to FIGS. 2 to 4, there is shown the intermediary ink tank 100 according to a first embodiment for use in the gravity-feed ink delivery system described above. The ink tank 100 comprises a rigid plastics housing 101 having a generally stepped external structure housing internal chambers. A lower part of the housing 101 comprises a first ink chamber 120 having sidewalls 121 defining the ink inlet port 110, the ink outlet port 106 and the ink return port 108. An upper second ink chamber 122 comprises a second ink chamber roof 123 having a gas port 109 open to atmosphere. In use, the second ink chamber 122 has a relatively constant head of ink which controls the back-pressure at the printhead 4. For example, the sensors 102 and 104 shown in FIG. 1 may be fitted to a sidewall 125 of the second ink chamber 122 and, together with the first controller 107 and control valve 30, may be used to regulate a level of ink in the second ink chamber. The second ink chamber 122 has a larger volume and cross-sectional area than the first ink chamber 120, which effectively dampens variations of the ink level in the second ink chamber.

The second ink chamber 122 is fluidically connected to the first ink chamber 120 via a diffusion tube 124 extending therebetween. The diffusion tube 124 is formed of rigid air-impermeable plastics and is configured such that air dispersed in ink contained in the second ink chamber 122 propagates along a length of the diffusion tube towards the first ink chamber 120 in a diffusion timescale of at least 5 days. The diffusion timescale for solutes diffusing along a one-dimensional channel is given by Fick's law of diffusion:

$$\tau = L^2/D$$

where L is the length of the tube and D is the diffusivity of air in the ink.

Air has a predetermined diffusivity in the ink depending on factors, such as viscosity, temperature and water mass fraction of the ink. The Applicant's modelling has found that the diffusivity D of air in various inks can be described by the formula:

$$D \approx 6.56 \times 10^{-15} (1.4)^{x_d} \frac{T}{\mu_{ink}}$$

where:

$$x_d = \left\{ 5\left(\frac{1}{\omega_w} - 1\right)^{-1} + 1 \right\}^{-1}$$

T is the ink temperature (in Kelvin), $\mu_{ink}$ is the ink viscosity (mPa s) and $\omega_w$ is the water mass fraction in the ink.

Thus, the characteristic time scale, τ, for diffusion of air along impermeable tubing of length L can be written as follows:

$$\tau = \frac{L^2 \mu_{ink}}{6.56 \times 10^{-15} (1.4)^{\left\{5\left(\frac{1}{\omega_w}-1\right)^{-1}+1\right\}^{-1}} T}$$

Further, the length of impermeable tubing required to protect the first ink chamber 120 for a given period of time τ is provided by:

$$L = \sqrt{\frac{6.56 \times 10^{-15} (1.4)^{\left\{5\left(\frac{1}{\omega_w}-1\right)^{-1}+1\right\}^{-1}} T\tau}{\mu_{ink}}}$$

By way of example, Table 1 estimates the diffusivity of two pigment-based inks at 25° C. using the above modelling:

TABLE 1

Estimation of diffusivity of cyan and black pigment-based inks

| Ink | Water mass fraction (%) | Viscosity (mPa s at 25° C.) | $x_d$ | D ($\mu m^2$/ms) |
|---|---|---|---|---|
| Ink 1 (cyan) | 0.66 | 2.8 | 0.0934 | 0.72 |
| Ink 2 (black) | 0.73 | 2.6 | 0.0689 | 0.77 |

Table 2 estimates the diffusivity timescales τ of the two inks for various lengths of the diffusion tube 124.

TABLE 2

Estimation of diffusion timescale for Ink 1 and Ink 2

| Tube length (m) | Diffusion timescale, Ink 1 (years) | Diffusion timescale, Ink 2 (years) |
|---|---|---|
| 0.5 | 11.0 | 10.3 |
| 1 | 44.0 | 41.2 |
| 5 | 1100 | 1030 |
| 10 | 4399 | 4119 |
| 0.04 | 0.07 (25 days) | 0.66 (24 days) |

For a diffusion tube length of 4 cm, the estimated diffusion timescale is about 25 days, which is an acceptable compromise between the design constraints of the intermediary ink tank and the period for regasification of degassed ink. In the event that degassed ink becomes aerated in the first ink chamber 120, this can be readily flushed from the system during initial printing and replenished with fresh degassed ink. Typically, aerated ink is most problematic during long print runs where outgassing can build up over time in the printhead.

As best shown in FIGS. 3 and 4, a first ink chamber roof 128 is tapered towards and meets with the diffusion tube 124. This tapering encourages any buoyant air bubbles trapped in the first ink chamber 120 to rise towards the diffusion tube 124 and into the second ink chamber 122 by means of flotation.

Figure 5:
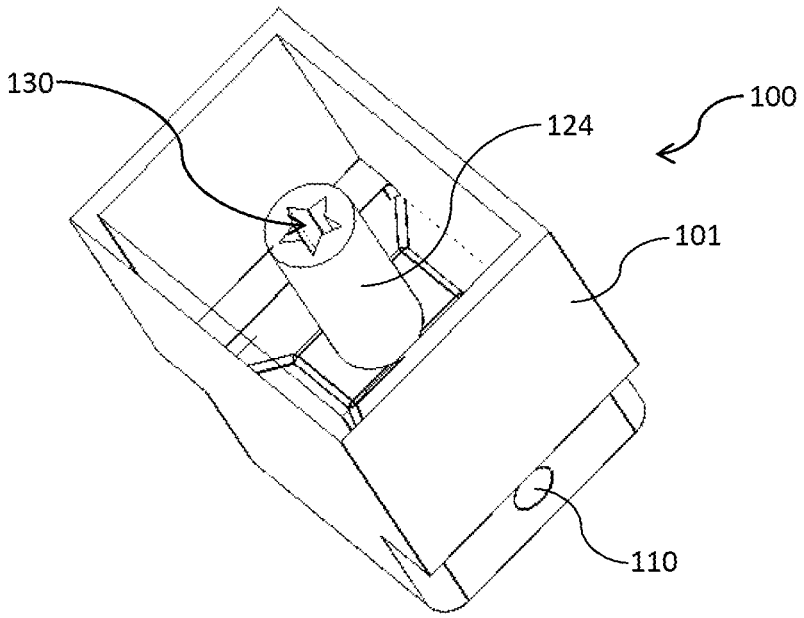
FIG. 5 is a perspective top section of the ink tank shown in FIG. 2.

Referring to FIG. 5, the diffusion tube 124 has a star-shaped internal cross-section 130. The star-shaped internal cross-section 130 is bubble-tolerant and allows the flow of liquid through the peripheral points of the star structure, even if an air bubble occludes a central portion of the star. It is preferable for the diffusion tube 124 to be bubble-tolerant so that the first ink chamber 120 always experiences head pressure from the second ink chamber 122 and, therefore, maintains pressure regulation in the ink delivery system. Other types of bubble-tolerant tubes will be well-known the person skilled in the art.

Intermediary Ink Tank (Second Embodiment)

Figure 6:
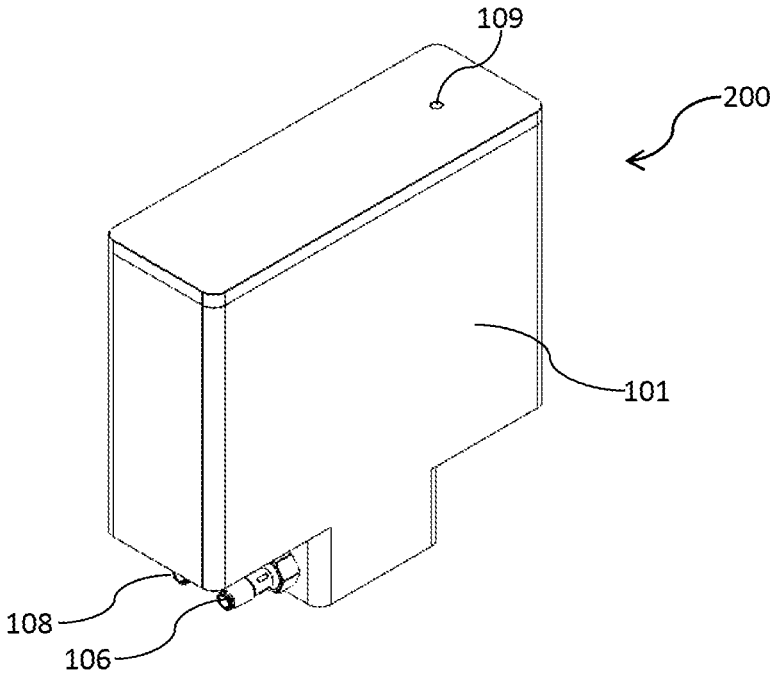
FIG. 6 is a perspective view of an ink tank according to a second embodiment.
Figure 7:
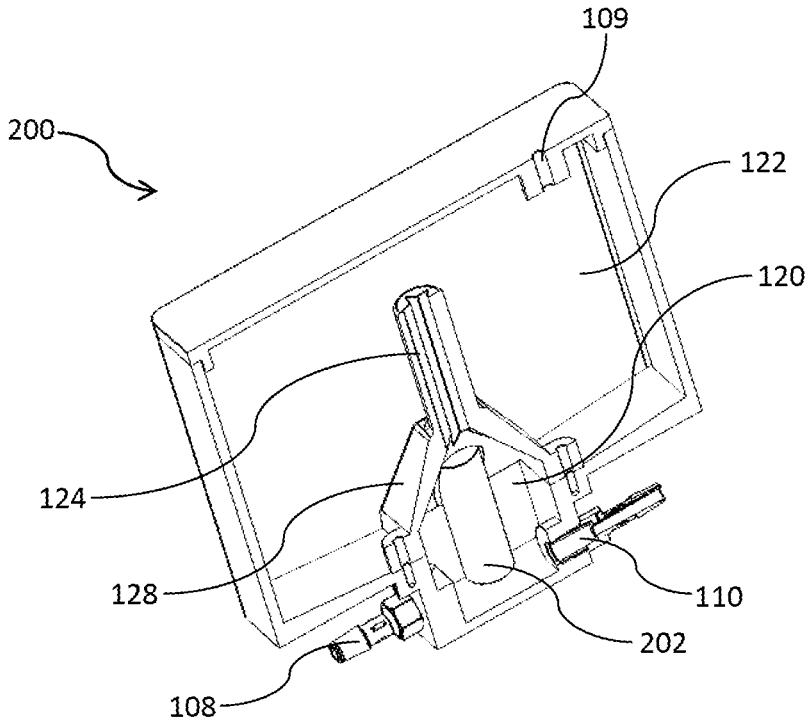
FIG. 7 is a perspective front section of the ink tank shown in FIG. 6.
Figure 8:
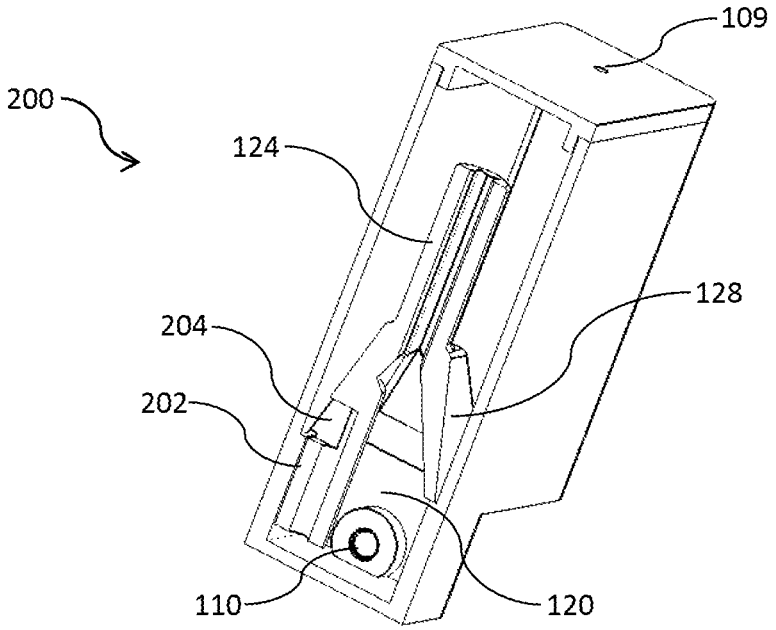
FIG. 8 is a perspective side section of the ink tank shown in FIG. 6.

Referring to FIGS. 6 to 8, there is shown an intermediary ink tank 200 according to a second embodiment. Where relevant, like references will be used to describe like features of the ink tanks 100 and 200. Accordingly, it will be seen that the ink tank 200 according to the second embodiment has similar functional features to the ink tank 100 described above in connection with FIGS. 2 to 5. In particular, the housing 101 contains the lower first ink chamber 120 and second ink chamber 122, which are interconnected via the diffusion tube 124 extending from the first ink chamber roof 128 and into a body of the second ink chamber. The first ink chamber has the ink inlet port 110, the ink outlet port 106 and the ink return port 108, while the second ink chamber has the gas port 109 open to atmosphere. The first ink chamber roof 128 is tapered towards the diffusion tube 124 to encourage flotation of air bubbles into the second ink chamber 122 in a similar manner to the ink tank 100. As described above, the diffusion tube 124 of the ink tank 200 according to the second embodiment functions as a diffusion barrier between the first and second ink chambers 120 and 122 so as to minimize ingress of aerated ink into the first ink chamber.

However, in contrast with the ink tank 100, the ink tank 200 according to the second embodiment has an additional drain tube 202, which allows ink to drain from the second ink chamber 122 when ink is required for certain priming operations. Hence, the second ink chamber 122 can still function as an ink reservoir if the level of ink falls below the top of the diffusion tube 124.

The drain tube 202 extends from a drain inlet 204 in the base of the second ink chamber 122 towards a base of the first ink chamber 120 and is dimensioned to minimize diffusion in a similar manner to the diffusion tube 124.

Intermediary Ink Tank (Third Embodiment)

Figure 9:
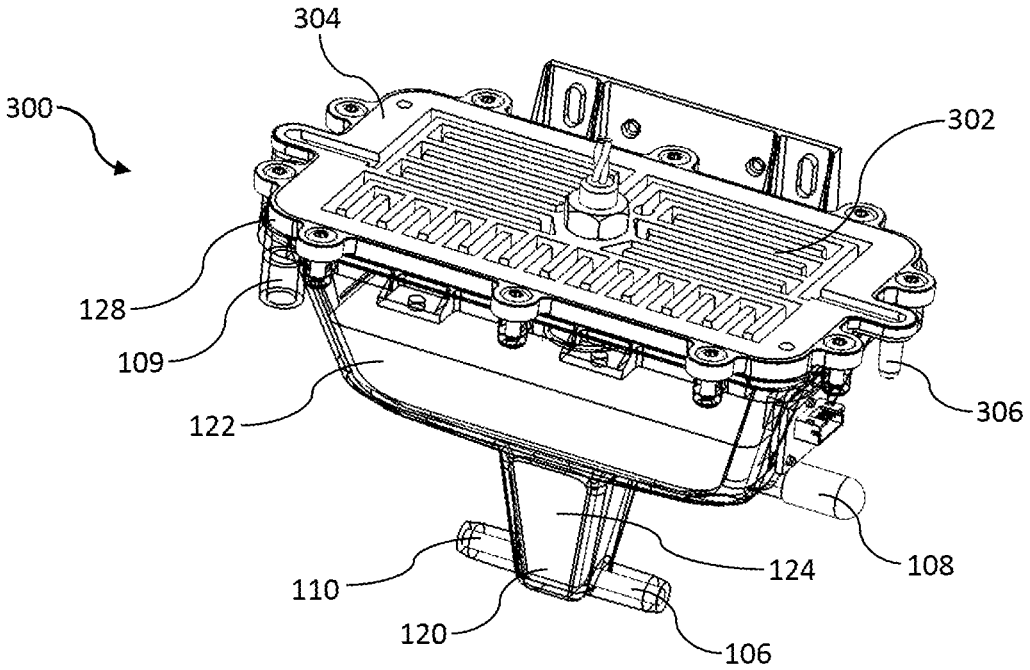
FIG. 9 is a perspective view of an ink tank according to a third aspect.

Referring to FIG. 9, there is shown an intermediary ink tank 300 according to a third embodiment. Where relevant, like references will be used to describe like features of the ink tanks according to the first, second and third embodiments and it will be appreciated that the ink tanks 100, 200 and 300 may be used interchangeably in the ink delivery system shown in FIG. 1.

Accordingly, it will be seen that the ink tank 300 according to the third embodiment comprises the lower first ink chamber 120 and the upper second ink chamber 122, which are interconnected via the diffusion tube 124 extending between the two chambers. In the ink tank 300, the lower first ink chamber 120 has a minimum volume, being defined essentially by a space between the ink inlet port 110 and the ink outlet port 106. The diffusion tube 124 of the ink tank 300 is tapered from a floor of the second ink chamber 122 towards the lower first ink chamber 120 for ease of manufacture. In contrast with the ink tanks 100 and 200 according to the first and second embodiments, the ink tank 300 according to third embodiment has the ink return port 108 connected to the upper second ink chamber 122. This arrangement minimizes the volume of the first ink chamber 120 and facilitates manufacture of the ink tank 300, albeit with a slight compromise of efficiency in purging aerated ink from the printhead 4.

The ink tank 300 according to the third embodiment has a roof 128 defining a tortuous vent pathway 302 sealed with a metalized film 304 (shown as transparent in FIG. 9). The tortuous vent pathway 302 is connected to the gas port 109, which is open to atmosphere, as well as a secondary gas port 306. This arrangement provides sufficient air venting with minimal ink evaporation.

Float sensors (not visible in FIG. 9) are positioned in the ink tank 300 for monitoring a level of ink in the upper second ink chamber 122 so as to provide feedback to the first controller 107. The first controller 107 controls a flow of ink into the ink tank 300 via the control valve 30.

The ink tank 300 according to the third embodiment is a relatively simplified, low-cost design compared to the inks tanks 100 and 200 according to the first and second embodiments, but still retains the essential feature of separation of upper and lower chambers via the diffusion tube 124.

It will, of course, be appreciated that the present invention has been described by way of example only and that modifications of detail may be made within the scope of the invention, which is defined in the accompanying claims.

The invention claimed is:

1. An ink delivery system for an inkjet printer comprising:
an intermediary ink tank comprising:
- a first ink chamber having an ink inlet port and an ink outlet port;
- a second ink chamber having a gas port open to atmosphere, the first ink chamber being positioned below the second ink chamber and having a smaller volume than the second ink chamber; and
- a diffusion tube interconnecting the first and second ink chambers;
- an ink supply reservoir connected to the ink inlet port via an ink supply line;
- an inkjet printhead having a printhead inlet port connected to the ink outlet port; and
- a control system coordinating with the intermediary ink tank for controlling an ink pressure of ink delivered to the printhead, wherein the intermediary ink tank is positioned below the printhead for gravity control of ink pressure in the printhead.

2. The ink delivery system of claim 1, wherein the control system comprises one or more sensors for sensing a level of ink in the second ink chamber, a flow control mechanism for controlling a flow of ink through the ink supply line and a controller connected to the sensors and the flow control mechanism.

3. The ink delivery system of claim 2, wherein either the first ink chamber or the second ink chamber comprises an ink return port and the printhead comprises a printhead outlet port connected to the ink return port via an ink return line to provide a closed fluidic loop between the printhead and the intermediary ink tank.

4. The ink delivery system of claim 3, wherein the closed fluid loop comprises a pump and at least one valve.

5. The ink delivery system of claim 1, wherein, during use, ink contained in the first ink chamber is mobile relative to ink contained in the second ink chamber.

6. The ink delivery system of claim 1, wherein the second ink chamber has a larger cross-sectional area than the first ink chamber.

7. The ink delivery system of claim 1, wherein the diffusion tube has rigid sidewalls impermeable to air.

8. The ink delivery system of claim 1, wherein the diffusion tube has a length in the range of 1 to 10 cm.

9. The ink delivery system of claim 1, wherein the diffusion tube has an aspect ratio of at least 2:1.

10. The ink delivery system of claim 1, wherein a roof of the second in chamber defines a tortuous vent pathway open to atmosphere via the gas port.

11. The ink delivery system of claim 1, wherein a volume of the second ink chamber is at least 10 times a volume of the first ink chamber.

12. An ink tank for an ink delivery system in a printer, the ink tank comprising:
- a first ink chamber having an ink inlet port and an ink outlet port;
- a second ink chamber having a roof defining a tortuous vent pathway open to atmosphere via a gas port; and
- a diffusion tube interconnecting the first and second ink chambers, wherein:
the first ink chamber is positioned below the second ink chamber; and
the first ink chamber has a smaller volume than the second ink chamber.

13. The ink tank of claim 12, wherein the second ink chamber has a larger cross-sectional area than the first ink chamber.

14. The ink tank of claim 12, wherein the diffusion tube has rigid sidewalls impermeable to air.

15. The ink tank of claim 12, wherein the diffusion tube has a length in the range of 1 to 10 cm.

16. The ink tank of claim 12, wherein the diffusion tube has an aspect ratio of at least 2:1.

17. The ink tank of claim 12, wherein a volume of the second ink chamber is at least 10 times a volume of the first ink chamber.

* * * * *